US006736606B1

(12) United States Patent
Ohmi et al.

(10) Patent No.: US 6,736,606 B1
(45) Date of Patent: May 18, 2004

(54) VACUUM APPARATUS

(75) Inventors: Tadahiro Ohmi, 1-17-301, Komegafukuro 2-Chome, Aoba-Ku, Sendai-Shi, Miyagi 980-0813 (JP); Masaki Hirayama, Sendai (JP)

(73) Assignees: Tadahiro Ohmi, Sendai (JP); Tokyo Electron Limited, Tokyo (JP)

( * ) Notice: Subject to any disclaimer, the term of this patent is extended or adjusted under 35 U.S.C. 154(b) by 19 days.

(21) Appl. No.: 09/679,061

(22) Filed: Oct. 5, 2000

Related U.S. Application Data

(63) Continuation of application No. PCT/JP00/01292, filed on Mar. 3, 2000.

(30) Foreign Application Priority Data

Mar. 5, 1999 (JP) ..... 11-103038

(51) Int. Cl.[7] ..... F04B 25/00
(52) U.S. Cl. ..... 417/244
(58) Field of Search ..... 417/244, 306, 417/423.4, 470, 475, 474

(56) References Cited

U.S. PATENT DOCUMENTS

| | | | | | |
|---|---|---|---|---|---|
| 4,312,626 | A | * | 1/1982 | Juran | 417/216 |
| 4,390,322 | A | * | 6/1983 | Budzich | 417/243 |
| 4,484,861 | A | * | 11/1984 | Sweeney et al. | 417/15 |
| 4,523,897 | A | * | 6/1985 | Lower et al. | 417/244 |
| 4,640,667 | A | * | 2/1987 | Trepp | 417/52 |
| 4,718,836 | A | * | 1/1988 | Pottier et al. | 417/205 |
| 5,009,575 | A | * | 4/1991 | Hanai et al. | 415/55.1 |
| 5,165,864 | A | * | 11/1992 | Burger et al. | 417/2 |
| 5,238,362 | A | * | 8/1993 | Casaro et al. | 415/143 |
| 5,672,322 | A | * | 9/1997 | Visser | 110/345 |
| 5,803,713 | A | * | 9/1998 | Huse | 417/244 |
| 5,820,354 | A | * | 10/1998 | Wild et al. | 417/244 |
| 5,871,336 | A | * | 2/1999 | Young | 417/207 |
| 6,179,573 | B1 | * | 1/2001 | Hablanian | 415/90 |

FOREIGN PATENT DOCUMENTS

| | | |
|---|---|---|
| JP | 55-072672 | 5/1980 |
| JP | 56-146083 | 11/1981 |
| JP | 01-159475 | 6/1989 |
| JP | 06-193562 | 7/1994 |
| JP | 3017480 U | 8/1995 |
| JP | 07-321047 | 8/1995 |
| JP | 08-124866 | 5/1996 |
| JP | 9-184482 | 7/1997 |

* cited by examiner

*Primary Examiner*—Daniel Robinson
(74) *Attorney, Agent, or Firm*—Pillsbury Winthrop LLP

(57) ABSTRACT

The present invention provides a vacuum apparatus that includes a plurality of vacuum containers each having a gas inlet and an exhaust outlet, a gas supply system for introducing a desired gas into each of the vacuum containers through the gas inlet, and an exhaust system for keeping each of the vacuum containers at a low pressure. In this vacuum apparatus, the exhaust system includes a plurality of multistage vacuum pumps connected in series. The exhaust outlet pressure of the last-stage vacuum pump is substantially at atmospheric pressure. The last-stage vacuum pump is designed to exhaust gas from a plurality of vacuum pumps at previous stages.

12 Claims, 8 Drawing Sheets

VACUUM APPARATUS

This application is a continuation of PCT/JP00/01292 filed Mar. 3, 2000.

TECHNICAL FIELD

The present invention relates to vacuum apparatuses, and, more particularly, to a compact vacuum apparatus including vacuum pumps which consume only a small amount of electric power.

BACKGROUND ART

Vacuum apparatuses are used in various industrial fields, such as semiconductor manufacturing and liquid crystal display manufacturing. Particularly in the semiconductor manufacturing and liquid crystal display manufacturing, processes such as film formation and etching are performed in a low-pressure atmosphere in a vacuum apparatus. The vacuum apparatus normally includes vacuum pumps so as to maintain a vacuum state or low-pressure state in vacuum containers for performing the processes and measurement.

The conventional vacuum pumps are roughly divided into a discharge type and a storage type. A pump of the discharge type draws a gas in through an inlet and discharges the gas through an exhaust outlet. The storage type draws a gas in through an inlet and stores the gas inside the pump. Generally, a storage-type pump can be evacuated to a point of high vacuum, but the quantity of gas that can be stored is naturally limited. Therefore, in a process that is performed at a reduced pressure with a gas always flowing, a storage-type pump is not suitable, but a discharge-type pump is actually employed.

Generally, a discharge-type pump having a higher ultimate vacuum has a higher exhaust rate and a lower allowable back pressure. Examples of vacuum pumps that operate in a molecular flow range with a high ultimate vacuum of $1.33\times10^{-4}$ Pa ($10^{-6}$ Torr) include turbo-molecular pumps, screw pumps, and oil-diffusion pumps. These pumps each have a high exhaust rate, regardless of the size, and a very low allowable back pressure of 133 Pa (1 Torr) or lower. Examples of pumps that have low ultimate vacuums and operate at a back pressure substantially equal to atmospheric pressure include Roots pumps, screw pumps, rotary pumps, and diaphragm pumps. Examples of pumps having medium ultimate vacuums include mechanical booster pumps and executor pumps.

In a vacuum apparatus, it is necessary to employ optimum vacuum pumps, depending on a required gas pressure, gas cleanliness, gas flow rate, gas type, vacuum container volume, or the like. Generally, if the gas pressure is as high as 40 Pa (300 mTorr), a single pump that operates with a back pressure substantially equal to atmospheric pressure can be employed. On the other hand, if the gas pressure is low, an exhaust system in which a pump that operates in a molecular flow range and a pump that operates with a back pressure equal to atmospheric pressure are connected in series is employed instead of the single pump. If the gas flow rate is high, a booster pump is interposed between the two pumps, so that the three pumps are connected in series and to exhaust gas.

In a mass-production factory of semiconductors or liquid-crystal displays, most of the processes required for production are performed at a reduced pressure. In such a case, a plurality of vacuum containers to be processed are integrally mounted on one device, so that a plurality of cluster tools that can transport substrates between the vacuum containers are aligned. This means that, generally, a plurality of vacuum containers are arranged together. In a conventional device, one independent exhaust system is provided for each one of the vacuum containers. The vacuum containers are in one-to-one correspondence with vacuum pumps, and each of the vacuum pumps evacuates only each corresponding one of the vacuum containers.

A vacuum pump that operates at a back pressure equal to atmospheric pressure requires a large power for rotating a rotor and consumes much more electric power, compared with a pump that operates at a low back pressure and has the same exhaust rate. Also, such a vacuum pump is large and heavy. In the conventional device, it is necessary to employ such large and power-consuming vacuum pumps in the same number as the number of vacuum containers. As a result, the total power consumption and the installation area of the device are large, and the production costs cannot readily be lowered.

Furthermore, since a vacuum pump that operates at a back pressure equal to atmospheric pressure has a lower ultimate vacuum on the suction side, there is a problem that, once an impurity gas adheres to the surfaces of wafers or the inner surfaces of the vacuum containers, the processing performance drastically deteriorates. Also, it is often difficult to place such pumps in the vicinity of the vacuum containers, because these pumps are too large in size. Therefore, the vacuum pumps need to be connected by long piping lines. This is a main reason for a decrease in processing rate or processing efficiency in a process that requires a large quantity of flow gas.

Also, the exhaust gas discharged from the vacuum containers used for semiconductor production might contain precipitant substances. As a result, solid substances adhere to the inner walls of the piping lines, and the exhaust conductance of the vacuum apparatus is greatly reduced.

In view of the above problems, the principal object of the present invention is to provide a vacuum apparatus that consumes less electric power and has a smaller installation area, and in which a large quantity of gas can flow without impurity gases entering vacuum containers from the exhaust system. Another object of the present invention is to provide a vacuum apparatus that has no impurity gases entering into vacuum containers, and can prevent a decrease in exhaust conductance due to a smaller cross-sectional area of a piping line even when the vacuum apparatus is used in a production process in which a precipitant exhaust gas is generated.

DISCLOSURE OF THE INVENTION

To achieve the above objects, the present invention provides a vacuum apparatus that comprises a plurality of vacuum containers each having a gas inlet and an exhaust outlet, a gas supply system for introducing a desired gas into each of the vacuum containers through the gas inlet, and an exhaust system for keeping each of the vacuum containers at a low pressure. In this vacuum apparatus, the exhaust system has a plurality of multistage vacuum pumps connected in series; an exhaust outlet pressure of the vacuum pump at a last stage is substantially at atmospheric pressure; and the vacuum pump at the last stage is designed to exhaust gas from the plurality of vacuum containers.

In the vacuum apparatus of the present invention, a common auxiliary pump that evacuates a plurality of vacuum containers at once is added to the atmospheric side of the device so as to maintain the back pressure of the vacuum pump in the previous stage at a low pressure. Compared with the prior art in which the back pressure is atmospheric pressure, the operational power for the vacuum pumps is reduced, and the power consumption and the size of the vacuum pumps are also greatly reduced. As a result, the power consumption of the entire device and the installation area can be reduced. Thus, the vacuum apparatus can be produced at a lower cost.

Also, the ultimate vacuum of the vacuum pump in the previous stage can be improved so that impurity gases can be completely prevented from entering the vacuum containers. Furthermore, the size the vacuum pump in the previous stage is dramatically reduced, so that the vacuum pump can be placed in the vicinity of the vacuum containers. As a result, a large quantity of gas can flow at a low pressure, and the processing rate and processing efficiency can be greatly increased.

A removal unit that efficiently removes solid product materials from a precipitant exhaust gas contained in the exhaust gas can further be employed in the vacuum apparatus of the present invention. With such a removal unit, the exhaust conductance in the vacuum apparatus can be maintained in a desired state over a long period of time.

BEST MODE FOR CARRYING OUT THE INVENTION

The following is a description of embodiments of vacuum apparatuses of the present invention, with reference to the accompanying drawings. It should be understood that the present invention is not limited to the embodiments described below.

Embodiment 1

Figure 1:
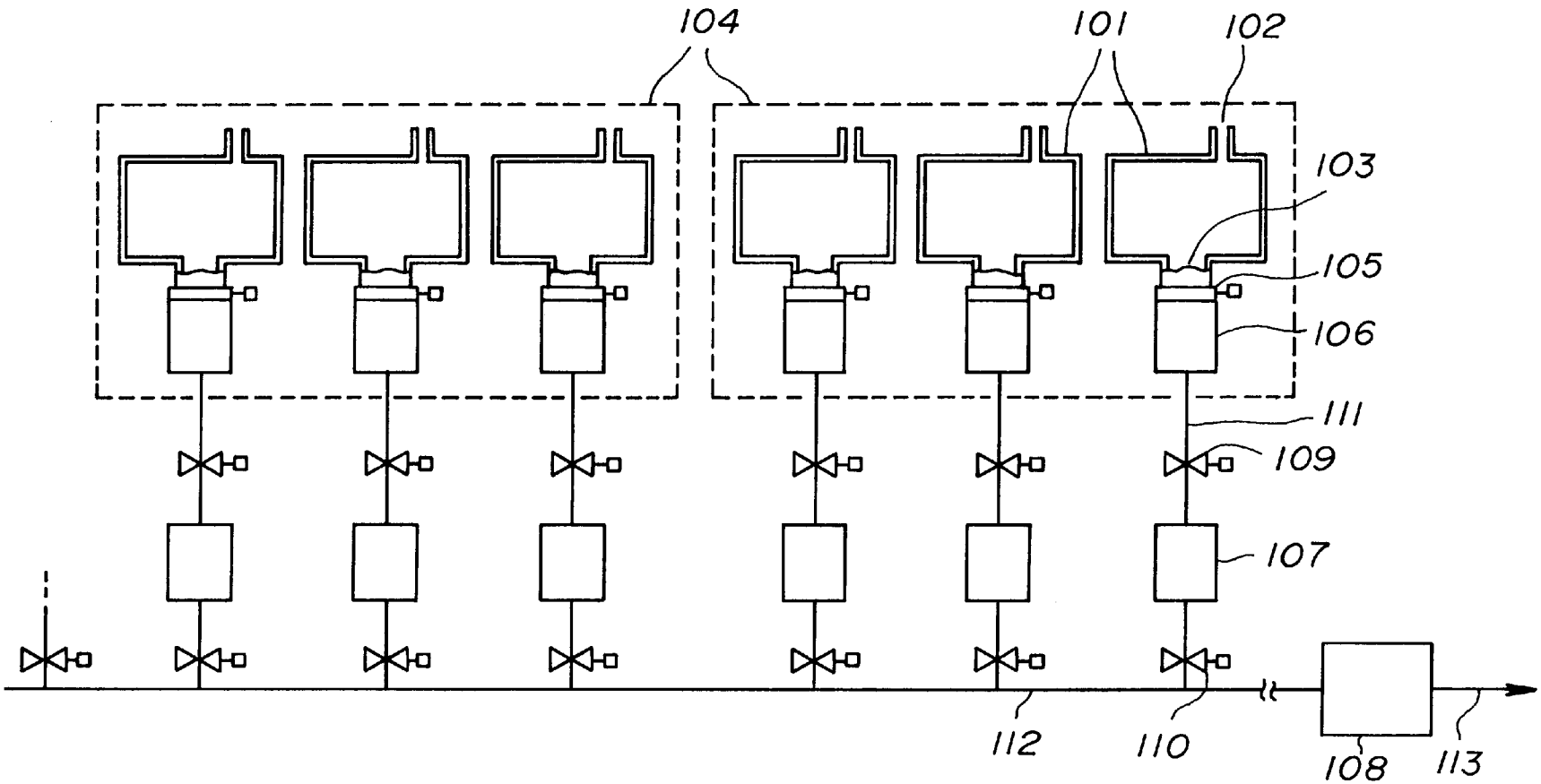
FIG. 1 is a schematic view of a vacuum apparatus in accordance with a first embodiment of the present invention.

FIG. 1 shows one embodiment in which a vacuum apparatus of the present invention is applied to a semiconductor processing apparatus.

Reference numeral 101 indicates vacuum containers, and reference numerals 102 and 103 indicate gas inlets and gas outlets provided for the vacuum containers 101. Reference numeral 104 indicates cluster tools each having three vacuum containers integrated on one platform. Reference numeral 105 indicates pressure control valves for controlling the gas pressure in the vacuum containers 101. Reference numeral 106 indicates high vacuum pumps that are screw molecular pumps in this embodiment. Reference numeral 107 indicates low vacuum pumps that are mechanical booster pumps for holding the back pressure of each high vacuum pump 106 low. Reference numeral 108 indicates an auxiliary pump that is a Roots pump for holding the back pressure of each low vacuum pump 107. Reference numerals 109 and 110 indicate valves that are electromagnetic valves in this embodiment. Reference numerals 111, 112, and 113 indicate piping lines for flowing gases. The piping line 113 is substantially at atmospheric pressure. The gas generated from the auxiliary pump 108 is introduced into a gas processing device through the piping line 113. This vacuum apparatus includes 33 cluster tools, i.e., 99 vacuum containers, connected by the piping line 112. However, for simplification of the drawing, only two cluster tools in FIG. 1. In this embodiment, the vacuum containers are used for etching a silicon substrate having a diameter of 200 mm or resist etching.

In the high-speed and high-performance etching of the substrate having the diameter of 200 mm, gases having a maximum flow rate of 1 atm·L/min (i.e., 1 L/min when calculated in the atmosphere, which is the same in the rest of the specification) at a pressure of approximately 4.00 Pa (30 mTorr) are used. The gases include Ar, CO, $C_2H_6$, and $O_2$, among which Ar is the main component. In the high-speed etching process, a gas having a maximum rate of 1 atm.L/min at a pressure of 6.67 Pa (50 mTorr) is used. The gas includes $O_2$. It is necessary to construct an exhaust system that can satisfy the above conditions.

As for the high vacuum pumps 106, screw molecular pumps having an exhaust rate of 1,800 L/sec or higher are required to maintain the inlet pressure at 4.00 Pa (30 mTorr) or lower when a gas having an exhaust rate of 1 atm.L/min flows. Accordingly, screw molecular pumps having an exhaust rate of 2,000 L/sec are employed in this embodiment. When the back pressure exceeds 53.55 Pa (0.4 Torr) in these screw molecular pumps, the compression ratio is greatly reduced to such a point that the screw molecular pumps cannot function as pumps. As for the low vacuum pumps 107, the inlet pressure is lower than 53.33 Pa (0.4 Torr) when a gas having an exhaust rate of 1 atm.L/min flows. Accordingly, the exhaust rate should be 1,900 L/min or higher, more preferably, 2,000 L/min or higher. For this reason, mechanical booster pumps each having an exhaust rate of 2,000 L/min are employed as the low vacuum pumps 107 in this embodiment. As for the auxiliary pump 108, a gas having an exhaust rate of 1 atm.L/min×99=9 atm.L/min flows into this pump if processes are performed simultaneously in all the vacuum containers. The allowable back pressure of a mechanical booster pump is $6.67\times10^3$ (50 Torr). Therefore, the auxiliary pump 108 needs to have an exhaust rate of 1,500 L/min or higher. Taking the gas conductance of the piping line 112 into account, a Roots pump having an exhaust rate of 2,000 L/min is employed as the auxiliary pump 108 in this embodiment.

Compared with the prior art, the power consumption of each high vacuum pump of this embodiment is 680 W, which is the same as in the prior art, and the total power consumption of 99 vacuum pumps of this embodiment is 68 kW, which is also the same as in the prior art.

As for the low vacuum pumps, the mechanical booster pumps operate at 1/10 of atmospheric pressure in this embodiment, while pumps such as the Roots pumps operate with a back pressure equal to atmospheric pressure. A comparison is now made between the Roots pumps and the mechanical pumps each having an exhaust rate of 2,000 L/min. The power consumption of each Roots pump is 3.7 kW, while the power consumption of each mechanical booster pump is 0.4 kW. Despite the same exhaust rate as each mechanical booster pump, the power consumption of each Roots pump is 9 times as high as the power consumption of each mechanical booster pump. This is because as the back pressure of each pump increases, a larger power is required for rotating the rotor. The volume of each Roots pump is $0.95\times0.42\times0.55$ $m^3$=0.22 $m^3$. The volume of each mechanical booster pump is $0.48\times0.21\times0.18$ $m^3$=0.018 $m^3$. Accordingly, the volume of each Roots pump is 12 times as large as the volume of each mechanical booster pump. The mass of each Roots pump is 223 kg, while the mass of each mechanical booster pump is 22 kg. The mass of each Roots pump is 10 times larger than the mass of each mechanical booster pump. Accordingly, the mechanical booster pumps that operate at a low back pressure are much smaller and consume much less electric power. Furthermore, the mechanical booster pumps have simpler structures, and are less expensive.

Figure 2:
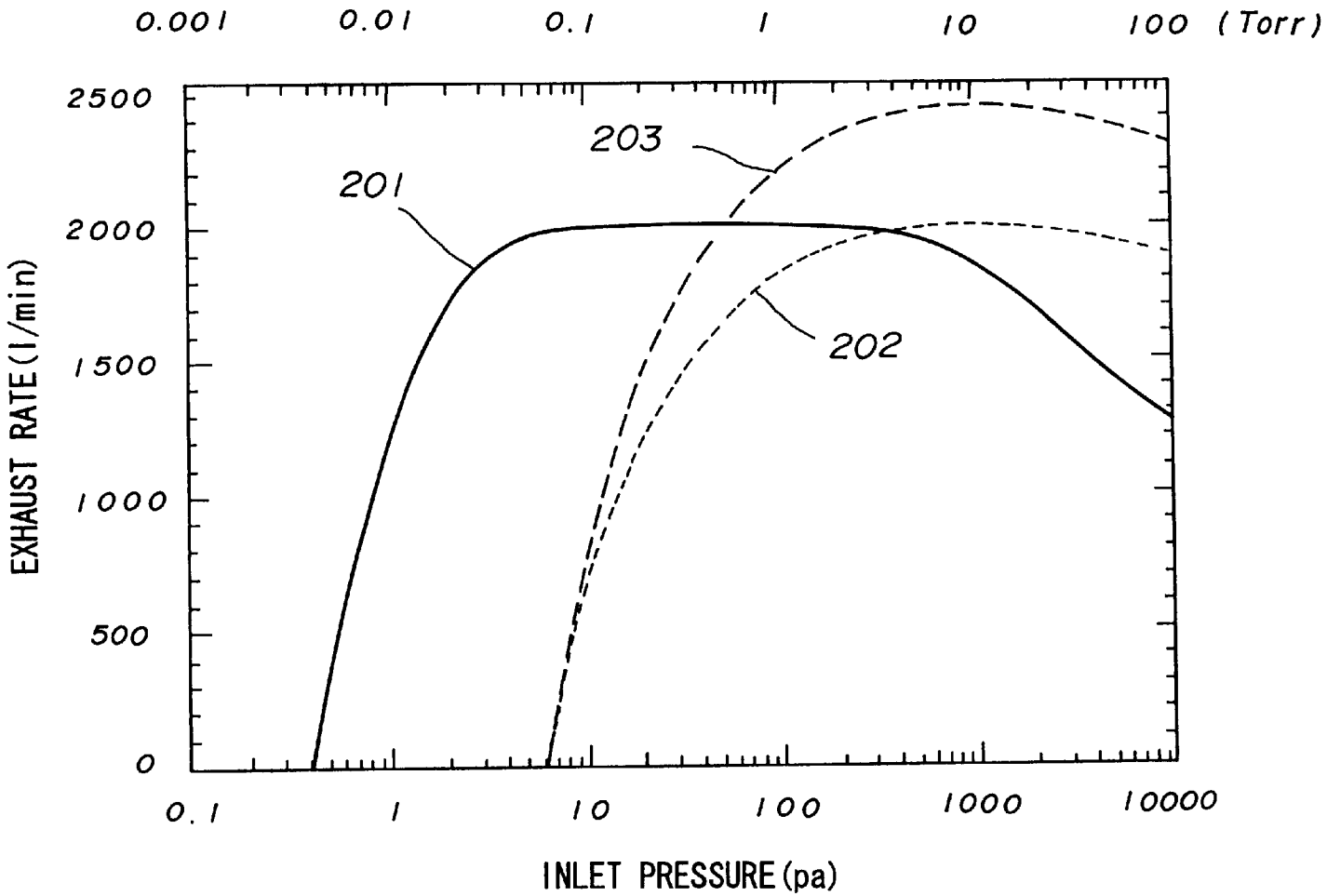
FIG. 2 is a graph showing exhaust characteristics between a mechanical booster pump and a Roots pump in accordance with the first embodiment of the present invention.

FIG. 2 shows the exhaust characteristics of a mechanical booster pump and Roots pumps. Reference numeral 201 indicates the characteristics of the mechanical booster pump having an exhaust rate of 2,000 L/min. Reference numeral 202 indicates the characteristics of a Roots pump having an exhaust rate of 2,000 L/min. Reference numeral 203 indicates the characteristics of a Roots pump having an exhaust rate of 2,400 L/min. As can be seen from FIG. 2, the mechanical booster pump operates in a low-pressure region in which the pressure is less than one tenth of the pressure of the Roots pumps. As a back pump for a molecular pump, it is necessary to employ a pump having a high exhaust rate at a pressure of 133.32 Pa (1 Torr) or lower. For the mechanical booster pump, the exhaust rate is maintained in a low-pressure region of approximately 4.00 Pa (30 mTorr). For each of the Roots pumps, the exhaust rate decreases in a pressure region of 133.32 Pa (1 Torr) or lower. Accordingly, to obtain an exhaust rate necessary for each of the Roots pump, it is necessary to employ larger pumps. For instance, to obtain an exhaust rate of 2,000 L/min at a pressure of 53.33 Pa (0.4 Torr) that is the allowable back pressure of a screw molecular pump, it is necessary to employ a Roots pump having an exhaust rate of 2,400 L/min, as can be seen from FIG. 2. As a result of a comparison between the mechanical booster pump having an exhaust rate of 2,000 L/min and the Roots pump having an exhaust rate of 2,400 L/min, it was found that the Roots pump has a power consumption 11 times as large as the power consumption of the mechanical booster pump, a volume 14 times as large as the volume of the mechanical booster pump, and a mass 12 times as large as the mass of the mechanical booster pump. With 99 low vacuum pumps, the power consumption of the Roots pump is 440 kW, while the power consumption of the mechanical booster pump is 40 kW.

In this embodiment, the power consumption of the auxiliary pump is added to the total power consumption. However, since a number of vacuum containers are evacuated by only the one auxiliary pump, the additional power consumption is a very small additional amount to the total power consumption. The total power consumption of all the vacuum pumps is 68 kW+440 kW=508 kW in the prior art, but 68 kW+40 kW+3.7 kW=111.7 kW in this embodiment. Accordingly, the power consumption can be reduced to 22% of the power consumption in the prior art.

Next, when no gases are flowing through the vacuum containers, the amount of impurity gases entering into the vacuum containers from the exhaust system is estimated. As can be seen from FIG. 2, the ultimate pressure of the Roots pumps is 6.00 Pa (45 mTorr), while the ultimate pressure of the mechanical booster pump is 0.53 Pa (4 mTorr). The compression ratio of the screw molecular pump is 3000 (with respect to a He gas). Taking only the gas entering from the exhaust system into account, the partial pressure of impurity gases in the vacuum containers is $2.00\times10^{-3}$ Pa ($1.5\times10^{-5}$ Torr) when the Roots pump is used as a back pump, and $1.73\times10^{-4}$ Pa ($1.3\times10^{-6}$ Torr) when the mechanical booster pump is used as a back pump. Accordingly, compared with the prior art, the quantity of the impurity gases entering into the vacuum containers from the exhaust system can be reduced to about one tenth of the quantity of impurity gases entering into the vacuum containers from the exhaust system in the prior art.

In a conventional vacuum apparatus, it is often difficult to dispose low vacuum pumps in the vicinity of the vacuum containers, because of the large size of each low vacuum pump. Therefore, long piping lines are necessary to connect the low vacuum pumps and the high vacuum pumps. As a result of this, when a large quantity of gas flows, the back pressure of the high vacuum pumps rises due to an influence of the gas conductance of the piping lines. For instance, when a gas having an exhaust rate of 1 atm.L/min flows, the pressure is 53.33 Pa (0.4 Torr) without piping lines. However, with a 10-meter long cylindrical piping line, the pressure is 11.99 Pa (0.84 Torr). To maintain the back pressure of the high vacuum pumps at 53.33 Pa (0.4 Torr) or lower, the gas flow rate should be 0.25 atm.L/min, which is one fourth of 1 atm.L/min, or lower. This is a principal cause of a decrease in processing rate or performance in the etching or plasma CVD process in which a large quantity of gas needs to flow. In this embodiment, on the other hand, the low vacuum pumps can be placed in the vicinity of the vacuum containers, because they are very small in size. The low vacuum pumps and the high vacuum pumps should be connected by short piping lines, so as not to restrict the gas flow rate.

For the piping lines 111, 0.55-meter long flexible tubes made of stainless steel are used. As described above, the gas conductance of the piping lines is large enough to ignore. For the piping line 112, a stainless-steel straight tube having an inner diameter of 40 mm and a length of 42 m is used. This diameter is not particularly large, but the pressure difference between both ends of the piping line 112 is only 386.63 Pa (2.9 Torr) even when a gas having the maximum gas flow rate of 99 atm.L/min flows. This pressure difference can be ignored. Accordingly, there is no need to employ a large-diameter piping line. Thus, an increase in piping cost can be prevented.

The auxiliary pump 108 and the piping line 113 are disposed outside the clean area of the semiconductor fabrication factory, while the other components are disposed within the clean area.

Second Embodiment

Figure 3:
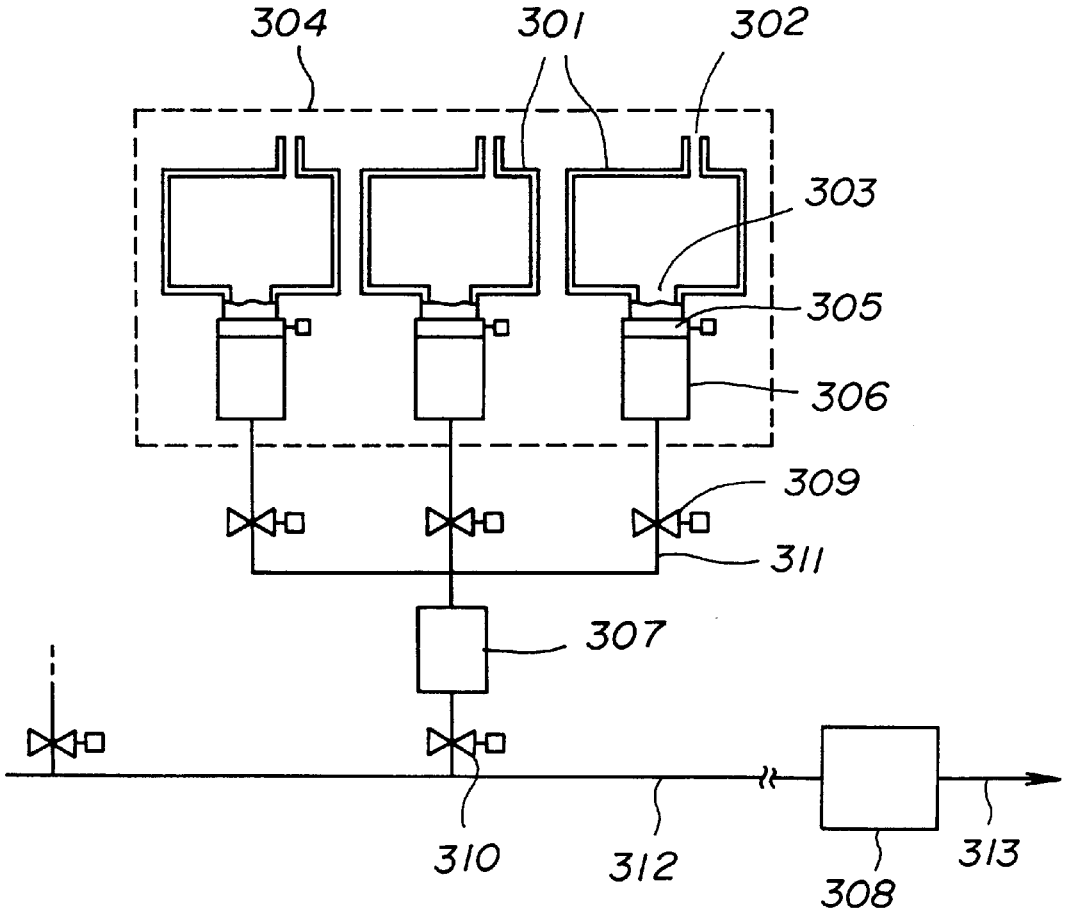
FIG. 3 is a schematic view of a vacuum apparatus in accordance with a second embodiment of the present invention.

FIG. 3 shows a second embodiment of the vacuum apparatus of the present invention applied to a semiconductor processing apparatus.

Reference numeral 301 indicates vacuum containers, and reference numerals 302 and 303 respectively indicate a gas inlet and a gas exhaust outlet formed in each of the vacuum containers 301. Reference numeral 304 indicates a cluster tool having three vacuum containers integrated on one platform. Reference numeral 305 indicates pressure adjustment valves for controlling the gas pressure in the vacuum containers 301 by changing gas conductance. Reference numeral 306 indicates high vacuum pumps that are screw molecular pumps in this embodiment. Reference numeral 307 indicates low vacuum pumps for keeping the back pressure of each of the high vacuum pumps 306 at a low value. The low vacuum pumps 307 are mechanical booster pumps. Reference numeral 308 indicates an auxiliary pump, which is a Roots pump in this embodiment. Reference numerals 309 and 310 indicate valves, which are electromagnetic valves in this embodiment. Reference numerals 311, 312, and 313 indicate piping lines for flowing gases.

The difference from the first embodiment resides in that each of the low vacuum pumps 307 evacuates three vacuum containers in the cluster tool. By sharing each of the low vacuum pumps 307 in this manner, the number of low vacuum pumps 307 can be reduced to one third, and compared with the first embodiment, the power consumption and the device installation area can be reduced. Thus, the costs for producing the device can be reduced.

Although one low vacuum pump evacuates three vacuum containers at the same time in this embodiment, the number of vacuum containers to be evacuated by one low vacuum pump is not limited to three.

Third Embodiment

Figure 4:
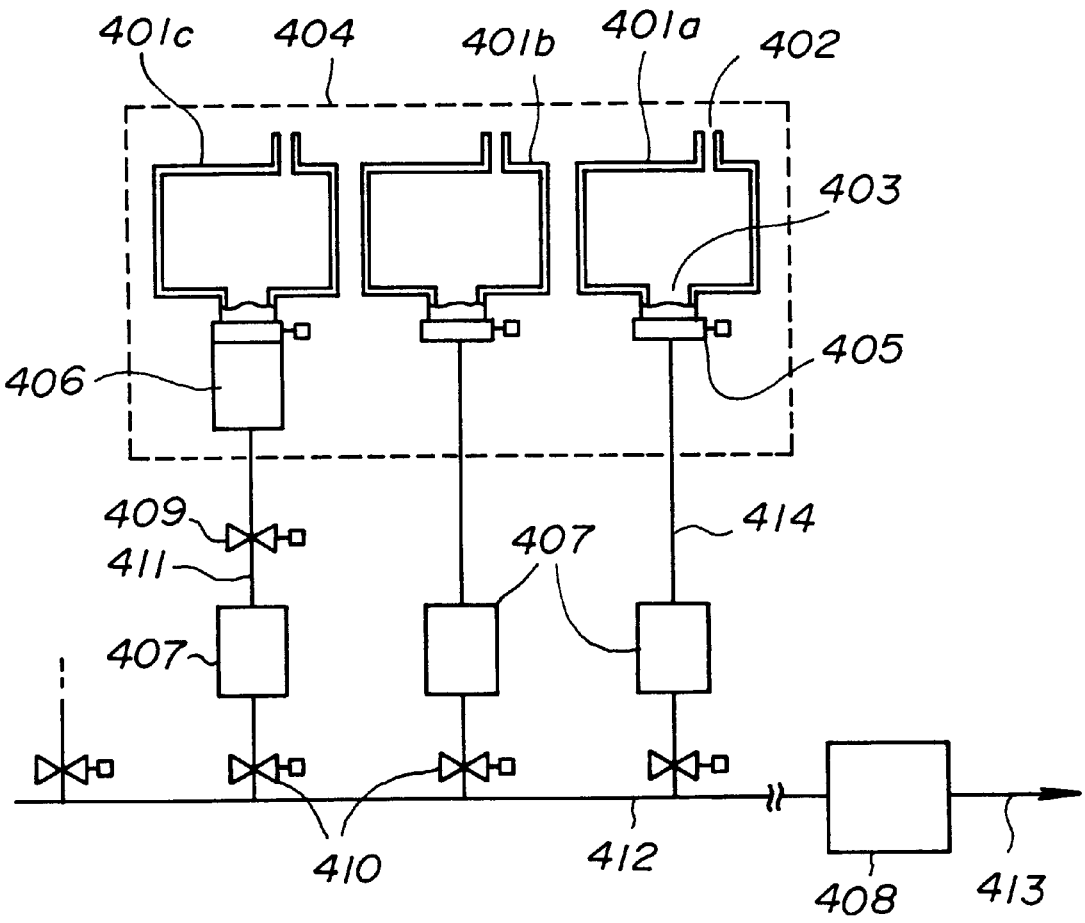
FIG. 4 is a schematic view of a vacuum apparatus in accordance with a third embodiment of the present invention.

FIG. 4 shows a third embodiment of the vacuum apparatus of the present invention applied to a semiconductor processing apparatus.

Reference numerals 401*a*, 401*b*, and 401*c* indicate vacuum containers, and reference numerals 402 and 403 indicate gas inlets and gas exhaust outlets of the vacuum containers 401. Reference numeral 404 indicates a cluster tool having three vacuum containers integrated on one platform. Reference numeral 405 indicates pressure control valves for controlling the gas pressure in each of the vacuum containers 401 by varying gas conductance. Reference numeral 406 indicates a high vacuum pump, which is a screw molecular pump in this embodiment. Reference numeral 407 indicates low vacuum pumps, which are mechanical booster pumps in this embodiment. Reference numeral 408 indicates an auxiliary pump, which is a Roots pump in this embodiment. Reference numerals 409 and 410 indicate valves, which are electromagnetic valves in this embodiment. Reference numerals 411, 412, 413, and 414 indicate piping lines for flowing gases.

The vacuum containers 401*a* and 401*b* are plasma CVD devices for polysilicon, and perform processes at a relatively high pressure, for instance, at 53.33 Pa (400 mTorr). The vacuum container 401*c* is an etching device for polysilicon, and performs processes at a low pressure, for instance, at 4.00 Pa (30 mTorr). The difference from the first embodiment resides in that the two containers 401*a* and 401*b* are not connected to the high vacuum pump in the cluster tool, and are evacuated directly by the low vacuum pumps. Since the processes are performed at a relatively high pressure, for instance, at 53.33 Pa (400 mTorr), a high exhaust efficiency is not required at the low vacuum regions. When processes are performed at a relatively high pressure, no high vacuum pumps are mounted, which reduces the power consumption, the device installation area, and the entire costs.

Fourth Embodiment

Figure 5:
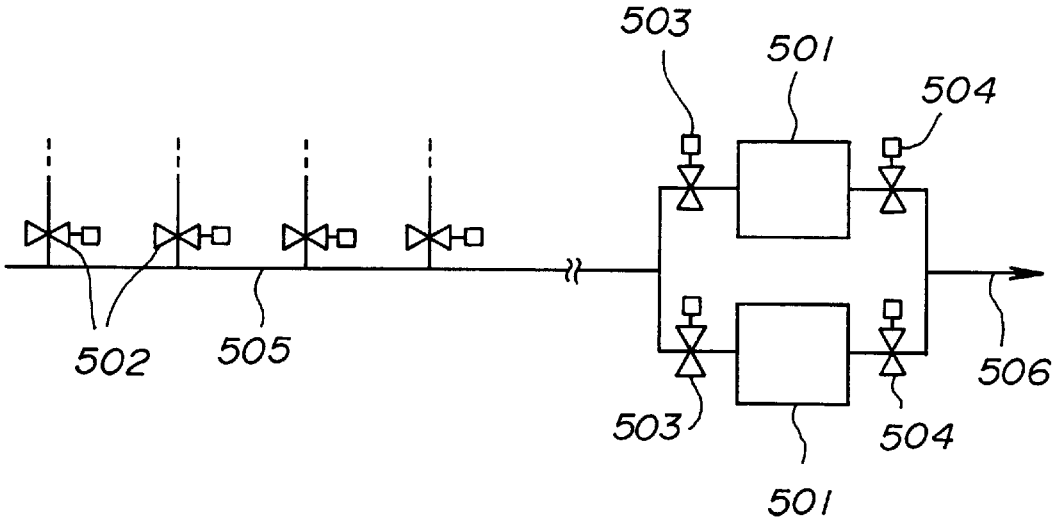
FIG. 5 is a schematic view of a vacuum apparatus in accordance with a fourth embodiment of the present invention.

FIG. 5 shows a fourth embodiment of the vacuum apparatus of the present invention applied to a semiconductor processing apparatus.

In FIG. 5, only the differences from the first embodiment are shown. Reference numeral 501 indicates auxiliary pumps constituted by two Roots pumps each having an exhaust rate of 2000 L/min connected in parallel. Reference numerals 502, 503, and 504 indicate valves; more specifically, the valve 502 is an electric valve, and the valves 503 and 504 are manual valves in this embodiment. Reference numerals 505 and 506 indicate piping lines for flowing gases. The piping line 506 is substantially at atmospheric pressure.

In the foregoing embodiments, one auxiliary pump evacuates a plurality of vacuum containers. As a result, if the auxiliary pump breaks down, all the vacuum containers become unavailable at once. In this embodiment, on the other hand, the valves 503 and 504 are normally open, and the two auxiliary pumps exhaust gas at the same time. If one of the auxiliary pumps 501 breaks down, the valves 503 and 504, which are located across the broken auxiliary pump 501, are closed, and the broken pump 501 is exchanged for a new one or fixed. During the exchanging or fixing operation, gas is exhausted by the other one of the two auxiliary pumps 501. In this manner, even if one of the auxiliary pumps breaks down, the vacuum apparatus itself can operate properly.

Fifth Embodiment

Figure 6:
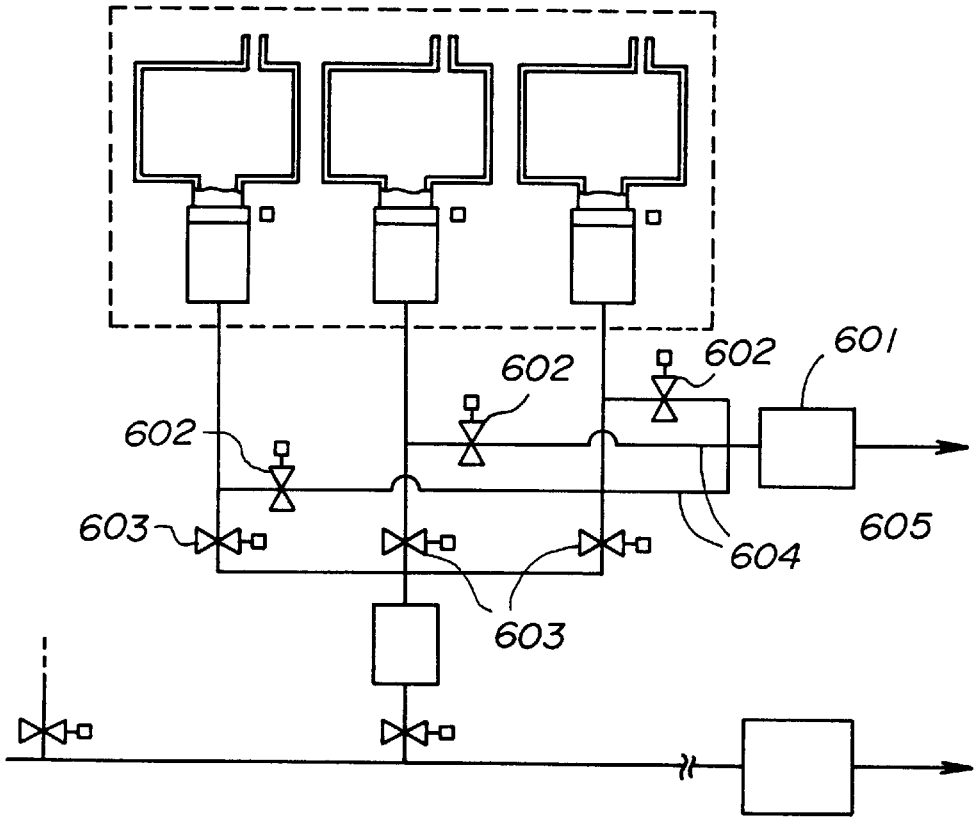
FIG. 6 is a schematic view of a vacuum apparatus in accordance with a fifth embodiment of the present invention.

FIG. 6 shows a fifth embodiment of the vacuum apparatus of the present invention applied to a semiconductor processing apparatus. The vacuum apparatus of this embodiment is the same as the vacuum apparatus of the second embodiment, except that a roughing exhaust system is used for evacuating each of the vacuum containers from the atmospheric pressure to a reduced pressure. In the following, only the modified aspects will be described.

Reference numeral 601 indicates a roughing pump. In this embodiment, this roughing pump 601 is a scroll pump having an exhaust rate of 360 L/min. The power consumption of the roughing pump 601 is as small as 0.45 kW. The roughing pump 601 is also small in size. The ultimate vacuum is 1.33 Pa (10 mTorr). Reference numerals 602 and 603 indicate valves, which are electric valves in this embodiment. Reference numeral 604 indicates piping lines, which are stainless-steel pipes each having a diameter of 9.525 mm (⅜ in.) in this embodiment. Reference numeral 605 indicates a piping line that is substantially at atmospheric pressure.

When a vacuum container is maintained, the vacuum container needs to be aired out. When the vacuum containers are evacuated again, a large quantity of air might flow into the exhaust system, and the back pressure of the low vacuum pumps might go up, resulting in an adverse influence on the other vacuum containers. This problem is to be solved by further employing a roughing exhaust system in this embodiment.

When a vacuum container is aired out, the corresponding high vacuum pump is stopped, and the corresponding valves 602 and 603 are in the closed state. When the vacuum container is evacuated again, the valve 602 is opened, with the valve 603 remaining in the closed state. The air is then discharged by the roughing pump 601 through the piping line 604. After that, at a point where the inner pressure of the vacuum container has been reduced to a degree in a range of 2,666 to 7,999 Pa (10 Torr or higher), the valve 602 is closed and the valve 603 is opened. The high vacuum pump is then actuated, and the operation returns to the normal operation state.

In this embodiment, two or more vacuum containers are not used at the same time in the cluster tool, so that the entering of gases can be completely prevented compared with the second embodiment by closing the valve 603 of the vacuum container that is not performing the processing and using the roughing pump 601 as a back pump for the high vacuum pumps. Thus, the cleanliness can be improved.

This embodiment is achieved by adding the roughing exhaust system to the vacuum apparatus of the second embodiment, but it should be noted that the same effects can be obtained by adding the roughing exhaust system to any one of the foregoing embodiments. Although the piping lines 604 are connected to the exhaust side of the high vacuum pumps in this embodiment, it is also possible to connect the piping lines 604 directly to the vacuum containers or to the exhaust side of the low vacuum pumps.

Sixth Embodiment

Figure 7:
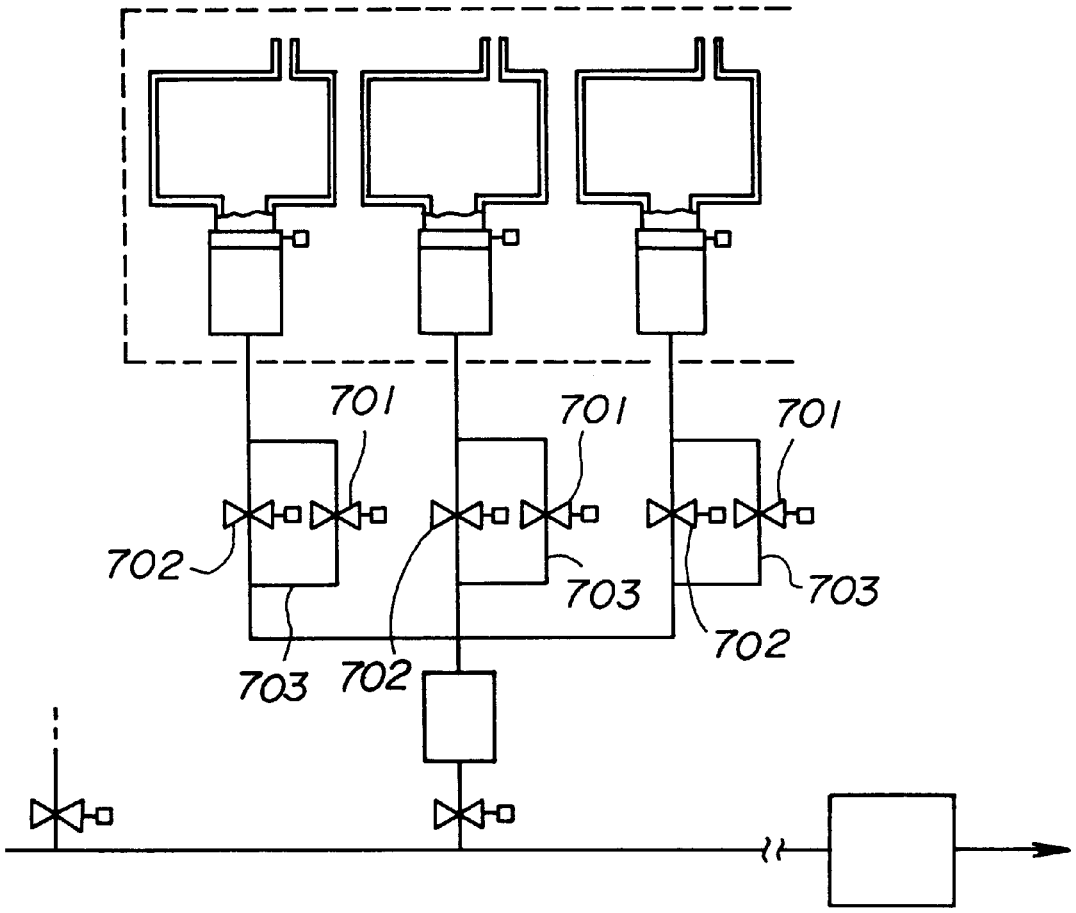
FIG. 7 is a schematic view of a vacuum apparatus in accordance with a sixth embodiment of the present invention.

FIG. 7 shows a sixth embodiment of the vacuum apparatus of the present invention applied to a semiconductor processing apparatus. The vacuum apparatus of this embodiment is the same as the vacuum apparatus of the second embodiment, except that a roughing exhaust passage for evacuating each vacuum container from atmospheric pressure to a reduced pressure is employed in the vacuum apparatus of this embodiment. In the following, only the modified aspects will be described.

Reference numerals 701 and 702 indicate valves, which are electric valves in this embodiment. Reference numeral 703 indicates piping lines, which are stainless-steel pipes each having a diameter of 3.175 mm (⅛ in.) in this embodiment.

When a vacuum container is opened to the air, the corresponding high vacuum pump is stopped, and the corresponding valves 701 and 702 are in the closed state. When the vacuum container is evacuated again, the valve 701 is opened, with the valve 702 remaining in the closed state, The air is then discharged by the low vacuum pump through the piping line 703. Since the piping line 703 has a small inner diameter and a small gas conductance, the flow rate of the gas flowing into the low vacuum pump is restricted, so as to restrain an increase in back pressure of the low vacuum pump. After that, at a point where the inner pressure of the vacuum container has been reduced to a degree in the range of 2,666 to 7,999 Pa (10 Torr or higher), the valve 701 is closed and the valve 702 is opened. The high vacuum pump is then activated, and the operation returns to the normal operation state.

In this embodiment, the roughing exhaust passage is added to the vacuum apparatus having the same structure as the second embodiment. However, it should be noted that the same effects can be obtained by adding the roughing exhaust passage to any one of the vacuum apparatuses of the first to fourth embodiments.

Seventh Embodiment

Figure 8:
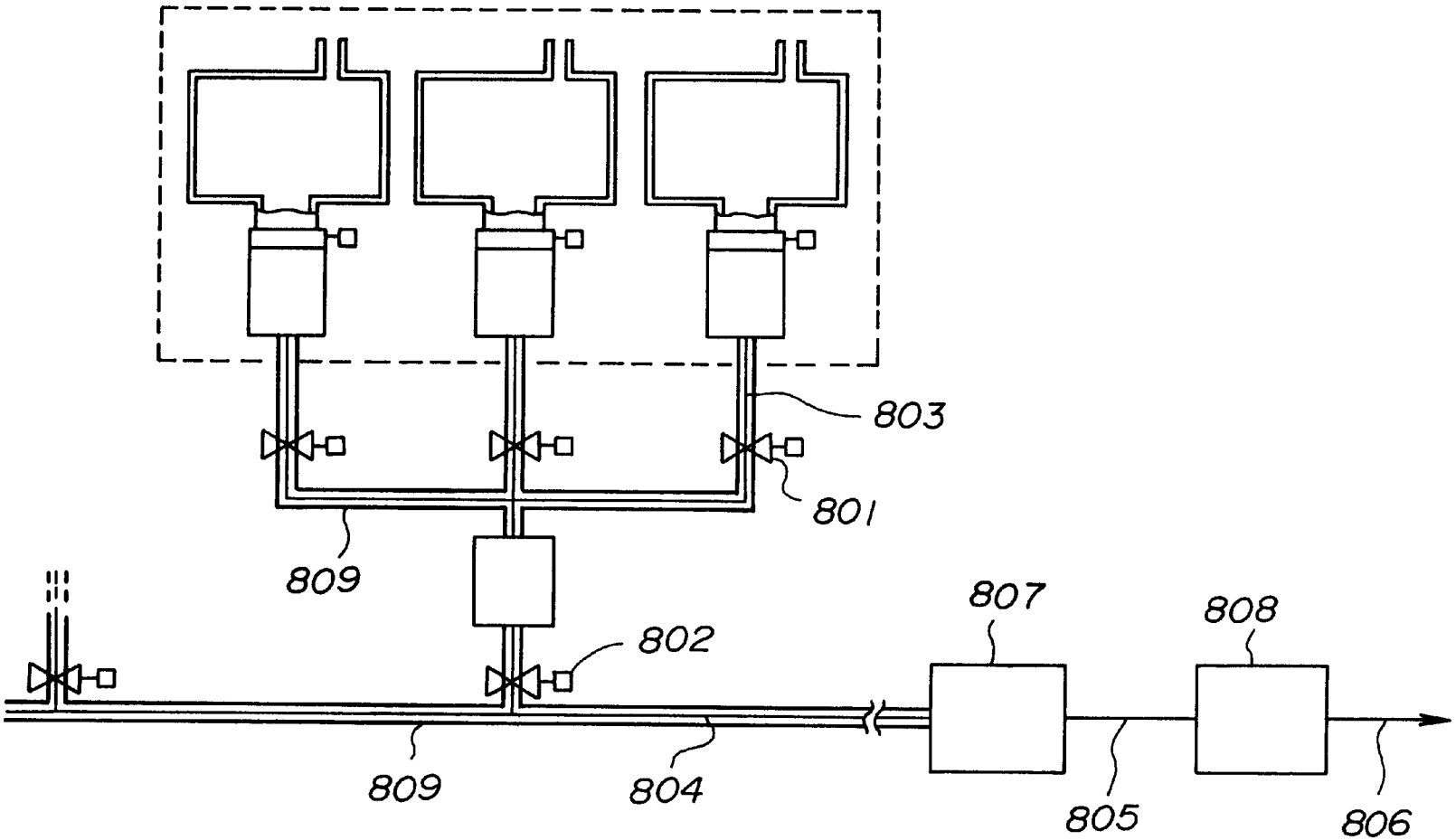
FIG. 8 is a schematic view of a vacuum apparatus in accordance with a seventh embodiment of the present invention.

FIG. 8 shows a seventh embodiment of the vacuum apparatus of the present invention applied to a semiconductor processing apparatus. The vacuum apparatus of this embodiment is the same as the vacuum apparatus of the second embodiment, except that a gas removal unit for removing a part of the gas and a heating unit for heating piping lines between vacuum containers are employed.

In FIG. 8, reference numerals 801 and 802 indicate valves each having a heater. Reference numerals 803 and 804 indicate piping lines each also having a heater. These piping lines 803 and 804 are covered with a rubber heater 809, and are thus maintained constantly at 90° C. or higher when the vacuum apparatus is used. Reference numerals 805 and 806 indicate normal piping lines. Reference numeral 807 is a water-cooled trap. Reference numeral 808 indicates an auxiliary pump equivalent to the auxiliary pump 308 of the second embodiment shown in FIG. 3.

In a plasma CVD apparatus or a plasma etching apparatus, a large amount of precipitant by-products is contained in an exhausted gas generated after processing in a vacuum container. These by-products are contained in the gaseous phase components and exhaust gas in the vacuum containers. As the by-products are cooled through the piping lines, they turn into solid phase components and might adhere to the inner walls of the piping lines. Such an adhering substance causes a decrease in exhaust performance of the vacuum pumps and a failure of the device itself. Such an adhering substance also reduces the cross-sectional area of each piping line, and thus reduces the exhaust conductance. Therefore, it is preferable to take suitable measures to prevent the adhesion of the precipitant by-products.

In this embodiment, the water-cooled trap 807 for removing the gaseous components, which cause the adhesion, is employed. Further, by heating the piping lines leading to the water-cooled trap 807 to such a temperature that causes no adhesion, no by-products adhere to the inner walls of the piping lines leading to the water-cooled trap 807.

Although the water-cooled trap 807 is employed to remove the precipitant components in the exhaust gas in this embodiment, other suitable devices can be employed. Also, the heating unit may be any type of heater, such as a ceramic heater, as long as it can heat the contact portion with the exhaust gas in the exhaust passage to 90° C. or higher. Accordingly, the heating unit that can be employed in this embodiment is not limited to the rubber heater of this embodiment.

This embodiment is a modification of the vacuum apparatus of the second embodiment, but it should be noted that the same effects can be obtained by making the same modification to any one of the foregoing embodiments.

As described so far, according to the present invention, the vacuum apparatus that consumes less electricity and has a smaller installation area can be obtained. In this vacuum apparatus, no impurity gas is introduced into the vacuum containers from the exhaust system, and a large quantity of gas can flow throughout the device.

Furthermore, with the removal unit for removing precipitant by-products contained in the exhaust gas, the exhaust conductance in the vacuum apparatus of the present invention can be maintained in a desired state over a long period of time.

What is claimed is:

1. A vacuum apparatus comprising:

a plurality of vacuum containers each having a gas inlet and an exhaust outlet, a gas supply system for introducing a desired gas into each of the vacuum containers through the gas inlet, and an exhaust system for keeping each of the vacuum containers at a low pressure, the exhaust system including a series connection of vacuum pumps connected so as to exhaust each of the vacuum container; wherein, an exhaust outlet pressure of the vacuum pump at a last stage is substantially at atmospheric pressure; and the vacuum pump at the last stage is constructed and arranged to be downstream of a plurality of previous stage vacuum pumps to exhaust gas from said plurality of the previous stage vacuum pumps.

2. A vacuum apparatus comprising:

a plurality of vacuum containers each having a gas inlet and an exhaust outlet, a gas supply system for introducing a desired gas into each of the vacuum containers through the gas inlet, and an exhaust system for keeping each of the vacuum containers at a low pressure, the exhaust system including plural initial stage vacuum pumps each connected to a respective corresponding exhaust outlet of its vacuum container, intermediate stage vacuum pumps connected downstream of the initial stage vacuum pumps, and a latter stage vacuum pump connected downstream of the intermediate vacuum pumps; wherein, an exhaust outlet pressure of the latter vacuum pump is substantially at atmospheric pressure; and the latter stage vacuum pump is constructed and arranged to exhaust gas from a plurality of the intermediate stage vacuum pumps.

3. The vacuum apparatus as claimed in claim 2, wherein at least one of the intermediate vacuum pumps is constructed and arranged to exhaust gas from a plurality of the initial stage vacuum pumps.

4. The vacuum apparatus as claimed in any one of claims 1 to 3, wherein:

roughing vacuum pumps are connected to the exhaust outlet of each of the vacuum containers or on a downstream side of each vacuum pump connected to each corresponding exhaust outlet of the vacuum containers, so as to evacuate each of the vacuum containers; and an exhaust inlet pressure of the roughing vacuum pump is substantially at atmospheric pressure.

5. The vacuum apparatus as claimed in claim 1, wherein a plurality of last stage vacuum pump are arranged in parallel.

6. The vacuum apparatus as claimed in claim 1, wherein a gas removal means that removes a part of the gas is disposed between each last stage vacuum pump and a previous stage vacuum pump.

7. The vacuum apparatus as claimed in claim 6, further comprising a heating means that heats a gas contact portion to 90° C. or higher in a gas exhaust passage between each vacuum container and the gas removal means.

8. The vacuum apparatus according to claim 1, wherein an absorption inlet ultimate pressure of the last stage vacuum pump is $6.67\times10^3$ Pa (50 Torr) or less.

9. The vacuum apparatus as claimed in claim 2, wherein a plurality of latter stage vacuum pumps are arranged in parallel.

10. The vacuum apparatus as claimed in claim 2, wherein a gas removal means that removes a part of the gas is disposed between each latter stage vacuum pump and a previous stage vacuum pump.

11. The vacuum apparatus as claimed in claim 10, further comprising a heating means that heats a gas contact portion to 90° C. or higher in a gas exhaust passage between each vacuum container and the gas removal means.

12. The vacuum apparatus according to claim 2, wherein an absorption inlet ultimate pressure of the latter stage vacuum pump is $6.67\times10^3$ Pa (50 Torr) or less.

* * * * *